United States Patent [19]

Strunk

[11] 3,941,320

[45] Mar. 2, 1976

[54] BRAKING DEVICE IN COIL SUPPORT FRAME OR CRADLE

[75] Inventor: Toni Strunk, Charlotte, N.C.

[73] Assignee: W. Schlafhorst & Co., Monchen-Gladbach, Germany

[22] Filed: Mar. 18, 1974

[21] Appl. No.: 452,144

[30] Foreign Application Priority Data

Mar. 16, 1973 Germany ..... 2313152

[52] U.S. Cl. ..... 242/18 DD; 242/68.4; 242/129.51

[51] Int. Cl.[2] ..... B65H 54/42; B65H 49/26

[58] Field of Search ..... 242/18 DD, 129.51, 68.4

[56] References Cited

UNITED STATES PATENTS

| | | | |
|---|---|---|---|
| 1,693,876 | 12/1928 | Unruh, Jr. | 242/129.51 X |
| 2,197,747 | 4/1940 | Naumann | 242/18 DD |
| 2,595,906 | 5/1952 | Thomas | 242/68.4 X |
| 2,711,293 | 6/1955 | Hanson | 242/129.51 |
| 2,743,061 | 4/1956 | Kingsbury | 242/18 DD |
| 2,865,577 | 12/1958 | Furst | 242/129.51 |

*Primary Examiner*—Stanley N. Gilreath
*Attorney, Agent, or Firm*—Herbert L. Lerner

[57] ABSTRACT

In a coil support frame of a winding machine having a pair of centering discs mounted in a position opposing one another and mutually spaced-apart so as to clamp a coil core therebetween, there is included a braking device operatively connected to at least one of the centering discs and actuable to brake rotation of the one centering disc and to apply pressure to the one centering disc in direction toward the other centering disc so as to reinforce the clamping force exerted by the pair of opposing centering discs on a coil core clamped therebetween.

3 Claims, 1 Drawing Figure

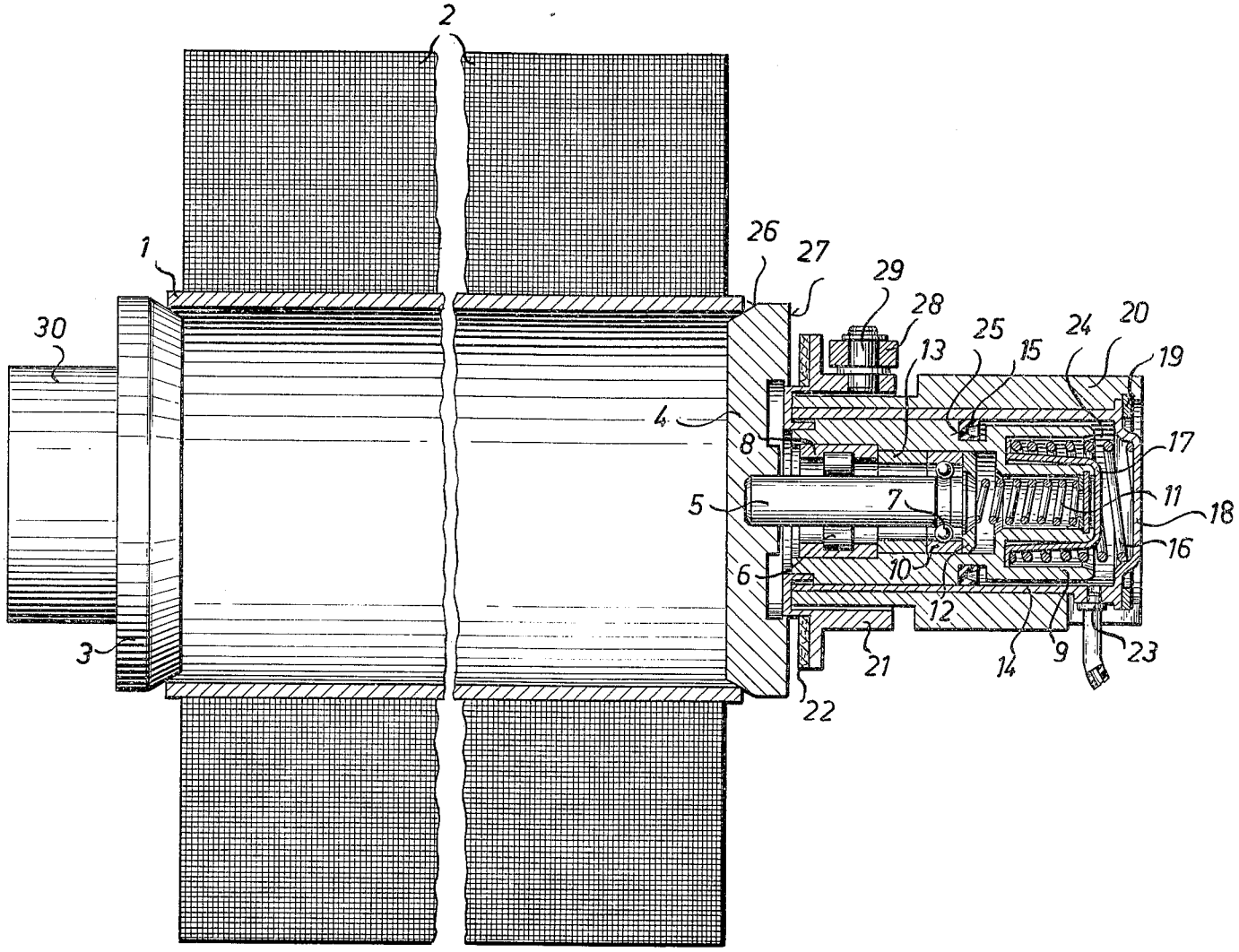
1
2
3
4
5
6
7
8
9
10
11
12
13
14
15
16
17
18
19
20
21
22
23
24
25
26
27
28
29
30

BRAKING DEVICE IN COIL SUPPORT FRAME OR CRADLE

The invention relates to a braking device in coil support frames or cradle of winding machines, and, more particularly, in such a coil support frame wherein a coil core or bobbin tube is clamped between two centering discs mounted in a position opposing one another.

In winding machines, such as coil or bobbin winders or the like, the necessity frequently exists to terminate as quickly as possible the rotary motion of the package that is being wound, when the winding operation is interrupted or terminated.

Numerous braking devices for this purpose have heretofore become known. They are generally contructed as shoe or disc brakes, and cooperate with the bearing or support for the coil tube or coil core mounting device.

To transmit the braking moment or torque to the wound package, bobbin tubes or coil cores have furthermore been known to be formed with cutouts or recesses which engage with a correspondingly shaped core or tube mounting member and thereby produce a positive locking or form-locking connection. Bobbin tubes or coil cores that are of such construction, however, are not usable universally and cause centering problems when inserted in the coil or yarn package support frame.

It has also been known heretofore to stop the rotation of the core or tube mounting member instantaneously by means of a detent or catch. However, this has the disadvantage that very high impact stresses occur, which result in rapid wear of all parts, and it is possible that the package being wound will become separated from the bobbin tube or coil core because it slips or slides therethrough. A further disadvantage of all heretofore known braking devices is that relatively large dimensions are required to supply the necessary braking forces.

It is accordingly an object of the invention to provide a braking device in coil support frames of winding machines which avoids the aforedescribed disadvantages of the heretofore known devices of this general type, and which can be accommodated in a minimum amount of space and permits the rotation of even the largest wound packages to be stopped reliably in a minimum of time without slippage of the coil windings along the core or tube and without requiring special cores or tubes or centering discs.

With the foregoing and other objects in view, there is provided in accordance with the invention, in a coil support frame of a winding machine having a pair of centering discs mounted in a position opposing one another and mutually spaced-apart so as to clamp a coil core therebetween, a braking device operatively connected to at least one of the centering discs and actuable to reinforce the clamping force exerted by the pair of centering discs on a coil core clamped therebetween.

In accordance with another feature of the invention, the braking device comprises a disc brake and a pressure medium acting thereon.

A particularly space-saving and effective construction wherein the introduced braking force can be applied directly, without detours, to the end face of a clamped core or tube, is provided in a coil support frame according to the invention wherein the one centering disc, has a conical clamping surface on the side thereof facing toward the other centering disc and is formed with a planar surface on the opposite side thereof, the braking device comprising a friction disc, and the planar surface of the one centering disc serving as a brake disc and contact surface for the friction disc.

If the effective friction diameter for the disc brake is selected so that it is somewhat smaller than the clamping diameter of the bobbin tube or coil core and if the coefficient of friction of the disc brake is selected so that it is somewhat smaller than the coefficient of friction between the bobbin tube or coil core and the one centering disc, no slippage can occur between the bobbin tube or coil core and the one centering disc.

Although the invention is illustrated and described herein as embodied in braking device in coil support frame or cradle it is nevertheless not intended to be limited to the details shown since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the single FIGURE of the drawing which is a longitudinal sectional view partly diagrammatic, of a braking device in a coil support frame of a winding machine in accordance with the invention.

Referring now to the drawing, there is shown therein a bobbin tube or coil core 1, with a yarn package 2 wound thereon, clamped between centering discs 3 and 4 of a conventional coil support frame, which is represented in the drawing only by the centering bearings 20 and 30 thereof. A centering disc 4 is press-fitted on a shaft 5 and is journalled in a roller bearing 6 as well as a ball bearing 7 so as to be readily rotatable. The outer race 8 of the roller bearing 6 is fixed in a bearing sleeve or bushing 9, but the outer race 10 of the ball bearing 7 is disposed so as to be displaceable in the bearing sleeve 9. In the illustrated position, the outer race 10 is biased into engagement with a spacer ring 13 by a compression spring 11 acting through a support ring 12. The spacer ring 13 is firmly seated in the bearing sleeve 9 and, furthermore, abuts the outer race 8 of the roller bearing 6 which is press-fitted in the bearing sleeve 9. The bearing sleeve 9 is seated in a compressed-air cylinder 14 wherein it is axially displaceable. The bearing sleeve 9 thus constitutes a piston within the cylinder 14, and is sealed by a sealing ring 15. A compression spring 16, which is braced at one end thereof against a bottom portion 18 of the compressed-air cylinder 14 and which, at the other end thereof, exerts a biasing force on the bearing sleeve 9 through a cup shaped member 17, provides for normal clamping of the bobbin tube or coil core 1. Under the biasing action of the compression spring 16, the bearing sleeve 9 together with the shaft 5 and the centering disc 4 also therewith can be shifted toward the left hand side, as viewed in the FIGURE, until the bobbin tube or coil core 1 is clamped between the centering disc 3 and the centering disc 4. The compressed-air cylinder 14 is held fast by the retaining ring 19, which is disposed in the bore of the centering bearing 20 that forms part of the coil support frame of a winding machine. A brake ring 21 is also firmly connected to the bearing sleeve or bushing 9 and, in turn, serves to carry a friction disc 22 which is suitably fastened thereon. Pressure medium, such as compressed air, for example, is supplied through a nipple 23.

When a bobbin tube or coil core 1 is clamped between the two centering discs 3 and 4, a predeterminable spacing exists between the bottom portion 18 of the compressed-air cylinder 14 and the bearing sleeve 9. The normal axially directed clamping force for the bobbin tube or coil core 1 is produced by the compression spring 16, as noted hereinbefore. If the rotational speed of a bobbin tube or coil core 1 with a wound package 2 thereon is to be decelerated or braked, a nonillustrated valve can be opened, in the conventional manner, to permit pressure to flow into the cylinder chamber 24 through the nipple 23. The pressure of the medium that is consequently exerted on the surface 25 of the bearing sleeve 9 will displace the latter to the left hand side, as viewed in the FIGURE. The centering disc 4 cannot be moved farther to the left hand side, because the clamped bobbin tube or coil core 1 prevents such added movement.

The compression spring 11 therefore becomes compressed, instead, and the bearing sleeve 9 is accordingly displaced in direction toward the centering disc 4. At the same time, the roller bearing 6 is also displaced, whereas the ball bearing 7 retains its position. An increasing gap is thus formed between the spacer ring 13 and the end face of the outer race 10 of the ball bearing 7, which faces the spacer ring 13. The bearing sleeve 9 can accordingly be shifted until the friction disc 22 becomes effective at a planar contact surface 27 of the centering disc 4 located opposite the clamping cone surface 26 thereof. A holder or arresting device 28 mounted on a pin 29 prevents the braking ring 21 from turning with respect to the centering bearing 20 due to the action of the friction torque. The pressure of the friction disc 22 acting on the centering disc 4 is thus added to the original clamping force produced by the compression spring 16 and effects, in this manner, rapid braking or deceleration of the rotating coil core 1 and wound yarn package 2 without slippage. If the braking pressure is removed after the previously rotating wound package 2 and bobbin tube coil core 1 have come to a standstill, the bearing sleeve 9 is again shifted back, under the effect of the compression spring 11, until the outer race 10 of the ball bearing 7 comes into engagement with the spacer ring 13.

I claim:

1. In a coil support frame of a winding machine having a pair of centering discs mounted in a position opposing one another and mutually spaced-apart means for urging at least one disc of the pair of centering discs toward the other so as to exert a clamping force on a coil core therebetween, at least said one disc of said pair of centering discs being rotatable, a braking device operatively connected to at least said one of the centering discs for braking rotation of the one centering disc and for applying pressure to the one centering disc in direction toward the other centering disc so as to reinforce the clamping force exerted by the pair of opposing centering discs on a coil core clamped therebetween.

2. In a coil support frame according to claim 1 wherein said braking device comprises a disc brake including disc-engaging means and means for displacing said disc-engaging means into engagement with said one centering disc, said displacing means including a pressure medium.

3. In a coil support frame according to claim 2 wherein the one centering disc has a conical clamping surface on the side thereof facing toward the other centering disc and is formed with a planar surface on the opposite side thereof, said disc-engaging means of said braking device comprising a friction disc, said planar surface of the one centering disc serving as a brake disc and contact surface for said friction disc.

* * * * *